US005156672A

United States Patent [19]

Bishop

[11] Patent Number: 5,156,672

[45] Date of Patent: Oct. 20, 1992

[54] MECHANICAL PLATING PASTE

[75] Inventor: Craig V. Bishop, Lakewood, Ohio

[73] Assignee: McGean-Rohco, Inc., Cleveland, Ohio

[21] Appl. No.: 553,775

[22] Filed: Jul. 13, 1990

[51] Int. Cl.[5] ..... C23C 18/54

[52] U.S. Cl. ..... 106/1.05; 106/1.16; 106/1.17

[58] Field of Search ..... 106/1.05, 1.11, 1.12, 106/1.13, 1.16, 1.17, 1.18, 1.22, 1.23, 1.26; 427/242, 406

[56] References Cited

U.S. PATENT DOCUMENTS

| | | | |
|---|---|---|---|
| 2,999,767 | 9/1961 | Clay et al. | 117/109 |
| 3,328,197 | 6/1967 | Simon | 106/1.05 |
| 3,400,012 | 9/1968 | Golben | 106/1.05 |
| 3,443,985 | 5/1969 | Cutcliffe | 117/109 |
| 3,460,977 | 8/1969 | Golben | 106/1.05 |
| 3,479,209 | 11/1969 | Clayton | 106/1.05 |
| 3,531,315 | 9/1970 | Golben | 117/50 |
| 3,709,714 | 1/1973 | Lee | 106/1.05 |
| 4,389,431 | 6/1983 | Erismann | 427/242 |
| 4,800,132 | 1/1989 | Grunwald et al. | 428/553 |

FOREIGN PATENT DOCUMENTS

| | | | |
|---|---|---|---|
| 3627256 | 2/1988 | Fed. Rep. of Germany | 106/1.05 |

*Primary Examiner*—Willliam R. Dixon, Jr.

*Assistant Examiner*—Paul Marcantoni

*Attorney, Agent, or Firm*—Renner, Otto, Boisselle & Sklar

[57] ABSTRACT

This invention relates to a paste composition, comprising:

(A) at least 12% by weight of a paste forming compound and (B) at least one oxidizing agent which is a metal oxide or salt;

(C) at least one reducing metal wherein (B) and (C) are capable of forming a metal coating;

(D) at least one nonreactive, powder material capable of being incorporated into the coating formed from (B) and (C) wherein the material is selected from the group consisting of a metal, a metal alloy and a polymer; or (E) mixture of two or more thereof.

The paste compositions control the pyrophoricity and explosive tendencies of the metal powders used in the process. Further, the paste affords easy handling of the materials. Delivery of the paste may be manual or automatic such as with a grease pump.

The mechanical plating compositions of the present invention may also include (D) a nonreactive, powder material capable of being incorporated into a coating wherein the material is selected from the group consisting of a metal, a metal alloy and a polymer.

26 Claims, No Drawings

MECHANICAL PLATING PASTE

FIELD OF THE INVENTION

This invention relates to mechanical plating compositions and processes for using the same.

BACKGROUND OF THE INVENTION

Mechanical plating involves the formation of a coating from an oxidizing agent and a reducing metal in the presence of an impacting media. The energy used to form the plate coating is the energy of collision between the items to be plated and the impact media in the presence of the oxidizing agent and the reducing agent. Generally, mechanical plating is accomplished by the use of metal, metal salt or metal oxide powders. One of the problems associated with the use of powdered metals and metal salts is the pyrophoric and explosive tendencies of metal powders. This is especially true of easily oxidized metals such as aluminum, yttrium, magnesium, titanium and zinc.

Often during mechanical plating, organic chemicals, such as inhibitors and surfactants, are used. These chemicals may be toxic or evolve vapors which are irritating and/or hazardous to operating personnel.

It is desirable to eliminate the pyrophoric and explosive tendencies of the metal powders used in mechanical plating. It is also desirable to minimize exposure of personnel to toxic and/or irritating materials.

U.S. Pat. No. 3,328,197 issued to Simon relates to mechanical plating promoter chemicals which are an acidic material and a material which prevents agglomeration of the metal particles in aqueous suspension. The materials that prevent aglomeration of the metal particles include gum colloids, fatty acids or amines, substituted primary, secondary or tertiary amines or amides, polyoxyethylene adducts of various amides, higher alkyl trimethyl ammonium salts, long-chained ternary amines solubilized with ethylene oxide, amphoteric proteinaceous compounds and the like.

U.S. Pat. No. 3,460,977 issued to Golben relates to mechanical plating processes using certain surfactants. These surfactants include anionic or nonionic dispersants.

U.S. Pat. No. 3,479,209 issued to Clayton relates to mechanical plating process wherein the metallic particles are in an aqueous medium which contains a water insoluble oxygen-substituted lubricious aromatic compound having a relatively high volatility and a relatively low viscosity.

U.S. Pat. No. 4,389,431 issued to Erismann relates to mechanical plating process which uses a chemical promoter system. The promoter system comprises a flash promoter which is a strong acid or an acid engendering salt, a soluble salt of a metal which is more noble than the plating metal, a dispersant, and an inhibitor. The dispersant includes polyoxyethylene glycols, quaternary aliphatic ammonium salts, proteinaceous materials and the like.

SUMMARY OF THE INVENTION

This invention relates to a paste composition, comprising:

(A) at least 12% by weight of a paste forming compound and (B) at least one oxidizing agent which is a metal oxide or salt;

(C) at least one reducing metal wherein (B) and (C) are capable of forming a metal coating in the presence of impact media and a fluidizing agent;

(D) at least one nonreactive, powder material capable of being incorporated into a coating formed from (B) and (C) wherein the material is selected from the group consisting of a metal, a metal alloy and a polymer; or a mixture of two or more thereof.

The paste composition is then added to a mechanical plating barrel containing parts to be plated, impact media, a fluidizing agent and other materials required for plating as described herein. This process avoids multiple additions of metals, metal salts, activators and promotors required by previous processes.

The paste compositions control the pyrophoricity and explosive tendencies of the metal powders often used in the mechanical plating process. Further, the paste affords easy handling of the materials as well as minimizes exposure of personnel to hazardous chemicals. Delivery of the paste may be manual or automatic such as with a grease pump.

DESCRIPTION OF THE PREFERRED EMBODIMENT

For mechanical plating to be successful, the reaction of the oxidizing agent and the reducing metal must have a negative Gibbs free energy.

The paste forming compound (A) is any material capable of preventing spontaneous heat production of the reducing metal or oxidizing agent. Generally, a humectant material is useful as a paste forming compound. Humectants are described in McCutcheon's Functional Materials, North American Edition 1989, pages 172–177, and the disclosure is hereby incorporated by reference. Examples of humectants include glycerol, propylene glycol, sorbitol, panthenol, diethylene glycol, triethylene glycol, ethoxylated or propoxylated glycerol, polyethylene glycol, polypropylene glycol, ethoxylated or propoxylated sorbitol and the like. Preferably the humectant is a glycerol, or polyethylene glycol. A useful polyethylene glycol is available commercially under the tradename Carbowax from Union Carbide Corporation. Specific polyethylene glycols are Carbowax PEG 200, 300, 400, 540, 600, 1000, and 1450. The numerical value approximates molecular weight. Typically the paste forming compound (A) is present in the paste at least 12% by weight, and can be present up to about 90%, preferably from about 5 to about 30%, more preferably about 15 to about 25%.

The oxidizing agent (B) is a metal oxide or salt. Preferably, the oxidizing agent is stannous chloride, stannous oxide, stannous sulfate, cupric chloride, cupric oxide, or cupric sulfate, more preferably stannous oxide.

The reducing metal (C) is preferably aluminum, yttrium, zinc, cadmium, tin, ductile brass or copper alloys, more preferably aluminum, yttrium or zinc, most preferably zinc.

The oxidizing agent and reducing metal are powders. Preferably, the average particle size of the oxidizing agent and reducing metal is 20 microns or smaller, preferably 12 to 15 microns.

In addition to (A) the paste forming compound, the paste used in the mechanical plating composition may contain (B) an oxidizing agent; (C) a reducing metal; or (B) and (C) together.

In the mechanical plating composition, (B) is present in the paste in an amount from about 5 to about 25% parts by weight per 100 milliliters of paste (%w/v), preferably about 10 to about 20%w/v. During mechanical plating, (B) is present in the barrel in an amount from about 0.1 to about 1 ounce per 0.0001 inch of desired coating thickness per 100 square feet of surface area of the item to be coated. (C) is present in the paste in an amount from about 5 to about 25%w/v, preferably about 10 to about 20%w/v. (C) is present in the barrel in an amount from about 4 to about 7 ounces per 0.0001 inch of desired coating thickness per 100 square feet of surface area of the item to be coated.

The mechanical plating pastes of the present invention may additionally contain (D), a nonreactive, powder material capable of being incorporated into a coating wherein the material is selected from the group consisting of a metal, a metal alloy and a polymer. The nonreactive powder material (D) preferably has a particles size of less than 20 microns. When (D) is a metal or metal alloy, it is generally present in the paste in an amount from about 1% to about 2% by weight. When (D) is a polymer, it is generally present in the paste in an amount from about 0.12 to about 0.25% by weight.

In one embodiment, the nonreactive material is a metal which is rhodium, palladium, silver, indium, platinum, gold, bismuth, nickel or titanium, preferably palladium, silver, platinum or gold, most preferably nickel or titanium.

In another embodiment, the nonreactive material is a metal alloy. Preferably, the metal alloy is a nickel or aluminum alloy such as 316 or 310 stainless steel.

In another embodiment, the nonreactive material is a polymer. Any solid polymer may be incorporated into the coating of the present invention provided it does not interfere with the coating. Preferably, the polymer is a polyamide or halogen-containing polymer.

When the polymer is a polyamide, it may be any of the polyamides which are generally known as nylons. Specific examples of nylons include polyhexamethylene adipamide, nylon-6/6; poly(episilon caprolactam), nylon-6; polypropiolactam, nylon-3; poly(pyrrolidin-2-one), nylon 4; poly(enanthamide), nylon-7; polycapryllactam, nylon-8; poly(pelargonamide), nylon-9; polyaminodecanoic acid, nylon-10; polyundecaneamide, nylon-11; and poly(hexamethylene dodecandiamide), nylon-6/12. A preferred nylon is nylon-6/6.

When the polymer is halogen-containing, the polymer is preferably a chlorine or fluorine-containing polymer. Specific examples of chlorine-containing polymers include polyvinylchloride (PVC), polyvinylidinechloride and the like. Examples of fluorine-containing polymers include polytetrafluoroethylene (PTFE), polyvinylidinefluorine and the like. Useful halogen-containing polymers which are available commercially are Kynar polymers available from Penwalt Corporation and Teflon polymers available from DuPont Company.

In one embodiment of the compositions of the present invention, the paste contains in addition to (A) any of (B), (C), (D), (E) or combinations of two or more thereof. Specific combinations include combinations of (B) and (C), (B) and (D) and (C) and (D). In another embodiment, the paste contains only (D).

Mechanical plating compositions of the present invention may additionally contain (E) a binder. The binder acts to enhance the viscosity characteristics of the paste. Specific examples of binders include but are not limited to agar, carrageenan, corn starch, guar gum, gum arabic, gum karays, gum tragacanth, locust bean gum, potato starch, wheat starch, rice starch, tapioca, casein, gelatin, pectin, sodium alginate, xanthan gum, aminoalkyl starches, dextran, hydroxyalkyl starches, hydroxyethyl cellulose, hydroxypropyl cellulose, methyl cellulose, laponite, hectorite, bentonite, sodium carboxymethyl cellulose, and the like. Preferred binders include but are not limited to sorbitol, iota carogeenan, guar gum, hydroxy cellulose, or laponite. The binder (E) is present in the paste in an amount from 0 to about 10% by weight, more preferably from 4 to 6.

The mechanical plating compositions of the present invention may additionally contain an abrasive (F). The abrasives are used to provide brightness and polish to the parts to be plated. Specific examples of abrasives include but are not limited to silica, pumice, aluminum, carborundum, diamond dust, a powdered mineral, calcium carbonate, diatomaceous earth or a zeolite.

The mechanical plating compositions of the present invention may additionally contain a detergent or surfactant (G) including nonionic, cationic, anionic or amphoteric surfactants. A variety of nonionic surfactants which can be utilized in the present invention are the condensation products of ethylene oxide and/or propylene oxide with compounds containing a hydroxy, mercapto or amino group containing at least one N-H. Examples of materials containing hydroxyl groups include alkyl phenols, styrenated phenols, fatty alcohols, fatty acids, etc. Examples of materials containing amino groups include alkylamines and polyamines, fatty acid amides, etc.

The mechanical plating compositions may additionally contain an inhibitor (H). The inhibitor (H) acts to control coating buildup on recesses of the item to be coated. The recesses of a screw, for instance, are the bottom of the grooves. The inhibitors include betaines, sulfur betaines, alkoxylated amines, quaternary ammonium salts, pyridinium salts, imidazoline salts, higher alkyl amine salts, and acetylenic compounds, preferably betaines, sulfo betaines, acetylenic compounds and quaternary ammonium salts.

The abrasive (F), dispersant or surfactant (G), and inhibitor (H) are present, if at all, in the barrel in amounts which would be known to those skilled in the art. The above materials may also be included in the paste. The abrasive (F) is present in the paste in an amount from 0% to about 10% by weight, more preferably from 4% to 6%. The dispersant or surfactant (G) is present in the paste in an amount from 0% to about 10% by weight, more preferably from 4% to 6%. The inhibitor (H) is present in the paste in an amount from 0% to about 10% by weight, more preferably from 1% to 2%.

The following examples illustrate pastes of the present invention.

EXAMPLE 1

A paste is prepared by adding 636 parts of pumice, 4.8 parts of Rodine 213 (a commercial mixture of a complex substituted keto-amine, isopropyl alcohol, propargyl alcohol, formaldehyde, and triphenyl sulfonium chloride, available from Amchem Products, Inc.), 174 parts of stannous oxide and 93 parts of aluminum powder (−200 mesh) to 681 parts of glycerol.

EXAMPLE 2

A paste is prepared by adding 20 parts carrageenan in the paste of Example 1.

EXAMPLE 3

A paste is prepared by adding 900 parts of aluminum powder to 200 parts of glycerol and 20 parts of carrageenan.

EXAMPLE 4

A paste is prepared by adding 700 parts of stannous oxide to 200 parts glycerol.

EXAMPLE 5

A paste is prepared by including 20 parts carrageenan in the paste of Example 4.

EXAMPLE 6

A paste is prepared by adding 200 parts of Nylon-6/6 to 100 parts of glycerol.

The mechanical plating composition of the present invention may be used in a process which involves making any of the pastes described above. The paste is added to mechanical plating equipment which contains an item to be plated, an impact media, a fluidizing agent and additionally contains materials necessary for successful mechanical plating. For instance, when the paste contains only an oxidizing agent, at least one reducing metal must be added to the mechanical plating equipment. Likewise, if the paste contains the reducing metal, then an oxidizing agent must be added to the mechanical plating equipment. If the paste contains the nonreactive material (D) then both an oxidizing agent and a reducing metal (B) must be added to the mechanical plating equipment.

After addition of the paste and necessary components to the mechanical plating equipment the components are brought into contact to cause plating.

The items which may be plated include any articles such as nails, washers, screws or the like.

The impact media are either glass beads or brush bristles. Glass beads may be glass beads of any size provided they are effective in allowing the metal platings to form in the present invention. Preferably, the glass beads are of various sizes ranging from 5 mesh up to and including 70 mesh.

When the impact media are brush bristles, the brush containing the bristles and method of using the brushes are described in U.S. Pat. Nos. 4,800,132, 4,202,915 and 4,293,584. The disclosure of those references is incorporated by reference for the teachings relating to brushes and methods for using brush bristles as impact media.

The fluidizing agent is present in the barrel in an amount sufficient to cover the items during plating. Fluidizing agents include water, lower alcohols, such as methanol, ethanol, or propanol, alkylene glycols such as ethylene glycol, propylene glycol, or butylene glycol, and the like. Typically the fluidizing agent is water.

In the process of the present invention the paste may be delivered manually or automatically to the mechanical plating equipment, preferably the paste is delivered automatically by a grease pump.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A mechanical plating composition, comprising:

(1) a non-explosive paste containing (A) at least about 12% by weight of a paste forming compound and (C) from about 5 to about 25% w/v of at least one pyrophoric reducing metal powder; and (2) (B) from about 5 to about 25% w/v of at least one oxidizing agent which is a metal oxide or salt; wherein (B) and (C) are capable of forming an impact metal coating in the presence of an impact medium and a fluidizing agent.

2. The composition of claim 1 wherein the paste-forming compound (A) is a humectant material.

3. The composition of claim 1 wherein the paste-forming compound (A) is glycerol, polyethylene glycol or triethylene glycol.

4. The composition of claim 1, wherein the oxidizing agent (B) is stannous chloride, stannous oxide, stannous sulfate, cupric chloride, cupric oxide or cupric sulfate.

5. The composition of claim 1, wherein the oxidizing agent (B) is stannous oxide.

6. The composition of claim 1, wherein the reducing metal (C) is aluminum, zinc, yttrium, cadmium or tin.

7. The composition of claim 1, wherein the reducing metal (C) is zinc.

8. A composition of claim 1, wherein the composition further comprises;

(D) at least one non-reactive powder material capable of being incorporated into a coating formed by (B) and (C), wherein the powder material is a metal, a metal alloy, or a polymer.

9. The composition of claim 8, wherein the powder material (D) has an average partical size of 20 microns or less.

10. The composition of claim 8, wherein the nonreactive material (D) is a metal which is rhodium, palladium, silver, indium, platinum, gold, bismuth, nickel or titanium.

11. The composition of claim 8, wherein (D) is a metal which is nickel or titanium.

12. The composition of claim 8, wherein the nonreactive material (D) is a polymer which is a polyamide, or a halogen containing polymer.

13. The composition of claim 11, wherein (D) is a halogen containing polymer selected from polyvinylchloride, polyvinylidenefluoride and polytetrafluoroethylene.

14. The composition of claim 11, wherein (D) is a polyamide of adipic acid and hexamethylene diamine.

15. The composition of claim 8, wherein (D) is a nickel or aluminum alloy.

16. The composition of claim 1, further comprising:

(E) a binder;

(F) an abrasive;

(G) a detergent; or (H) an inhibitor, or mixtures thereof.

17. The composition of claim 16, wherein the binder (E) is sorbitol, carrageenan, guar gum, hydroxy cellulose, or a synthetic smectite clay.

18. The composition of claim 16, wherein the abrasive (F) is silica, pumice, alumina, silicon carbide, diamond dust, calcium carbonate, diatomaceous earth or a zeolite.

19. The composition of claim 16, wherein the detergent or surfactant (G) is an alkyl sulfonate or alkoxylated substituted phenol.

20. The composition of claim 16, wherein the inhibitor (H) is an acetylenic compound or an amine salt.

21. The composition of claim 16, wherein the inhibitor (H) is propargyl alcohol, butynediol, or ethoxylated hexynediol, alkynol pyridinium or an ethoxylated quaternary amine.

22. The composition of claim 8, wherein the paste contains (D).

23. A non-explosive paste composition, useful in mechanical plating, comprising:

(A) from about 15% to about 30% by weight of at least one paste-forming compound;

(B) at least one oxidizing agent selected from a group consisting of stannous chloride, stannous oxide, cupric sulfate, or cupric chloride; and (C) at least one pyrophoric reducing metal powder selected from aluminum, zinc, yttrium, cadmium, or tin, wherein (B) and (C) of the paste are capable of forming a metal coating in the presence of an impact media and a fluidizing agent.

24. The composition of claim 23, wherein the oxidizing agent (B) is stannous oxide.

25. The composition of claim 23, wherein the reducing metal (C) is zinc.

26. The composition of claim 23, wherein the paste further comprises (D) at least one nonreactive powder material capable of being incorporated into a coating formed from (B) and (C) wherein the material is selected from the group consisting of a metal, a metal alloy and a polymer.

* * * * *